US007800490B2

(12) United States Patent
Allen et al.

(10) Patent No.: US 7,800,490 B2
(45) Date of Patent: Sep. 21, 2010

(54) ELECTRONIC ARTICLE SURVEILLANCE SYSTEM NEURAL NETWORK MINIMIZING FALSE ALARMS AND FAILURES TO DEACTIVATE

(75) Inventors: John A. Allen, Pompano Beach, FL (US); Adam S. Bergman, Boca Raton, FL (US); Manuel A. Soto, Lake Worth, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 296 days.

(21) Appl. No.: 11/971,255

(22) Filed: Jan. 9, 2008

(65) Prior Publication Data

US 2009/0174544 A1 Jul. 9, 2009

(51) Int. Cl.
*G08B 19/00* (2006.01)

(52) U.S. Cl. ..... 340/522; 340/523; 340/517; 340/501; 340/539.23; 340/521; 340/571; 340/572.1; 340/572.2; 340/568.1; 340/10.3; 367/93; 367/94; 367/98; 367/101; 367/107

(58) Field of Classification Search ..... 340/522, 340/517, 521, 572, 573, 541, 554, 567, 666, 340/500, 501, 10.3, 571, 568.1, 573.4, 572.3, 340/572.1; 367/93, 94, 98, 101, 107
See application file for complete search history.

(56) References Cited

U.S. PATENT DOCUMENTS 5,030,941 A * 7/1991 Lizzi et al. ..... 340/541
5,049,857 A * 9/1991 Plonsky et al. ..... 340/551
5,909,178 A 6/1999 Balch et al.

FOREIGN PATENT DOCUMENTS

EP 0410245 A1 1/1991
EP 0435198 A1 7/1991
WO 2009/011732 A1 1/2009

OTHER PUBLICATIONS

International Search Report and Written Opinion dated Apr. 2, 2009 for International Application No. PCT/US2008/013591, International Filing Date Oct. 12, 2008 (11-pages).

* cited by examiner

*Primary Examiner*—George A Bugg
*Assistant Examiner*—Sisay Yacob
(74) *Attorney, Agent, or Firm*—Alan M. Weisberg; Christopher & Weisberg, P.A.

(57) ABSTRACT

A method, system and computer program product for managing false alarms in a security system. A detection zone is established. An alarm event is triggered based on the detection of a tag in the detection zone using an initial alarm trigger sensitivity. The initial alarm trigger sensitivity is based on an initial set of one or more detection criteria. The set of detection criteria is modified to adjust the alarm trigger sensitivity of the security system.

20 Claims, 6 Drawing Sheets

ELECTRONIC ARTICLE SURVEILLANCE SYSTEM NEURAL NETWORK MINIMIZING FALSE ALARMS AND FAILURES TO DEACTIVATE

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention generally relates to electronic security systems, and in particular, to an improved electronic article surveillance ("EAS") system and method for decreasing false alarms.

BACKGROUND OF THE INVENTION

Electronic article surveillance ("EAS") systems are detection systems that allow the identification of a marker or tag within a given detection zone. EAS systems have many uses, but most often they are used as security systems for preventing shoplifting in stores or removal of property in office buildings. EAS systems come in many different forms and make use of a number of different technologies.

A typical EAS system includes an electronic detection unit, tags and/or markers, and a detacher or deactivator. The detection units can, for example, be formed as pedestal units, buried under floors, mounted on walls, or hung from ceilings. The detection units are usually placed in high traffic areas, such as entrances and exits of stores or office buildings. The tags and/or markers have special characteristics and are specifically designed to be affixed to or embedded in merchandise or other objects sought to be protected. When an active tag passes through a tag detection zone, the EAS system sounds an alarm, a light is activated and/or some other suitable alert devices are activated to indicate the removal of the tag from the prescribed area.

Common EAS systems operate with these same general principles using either transceivers, which each transmit and receive, or a separate transmitter and receiver. Typically the transmitter is placed on one side of the detection zone and the receiver is placed on the opposite side of the detection zone. The transmitter produces a predetermined excitation signal in a tag detection zone. In the case of a retail store, this detection zone is usually formed at an exit. When an EAS tag enters the detection zone, the tag has a characteristic response to the excitation signal, which can be detected. For example, the tag may respond to the signal sent by the transmitter by using a simple semiconductor junction, a tuned circuit composed of an inductor and capacitor, soft magnetic strips or wires, or vibrating acousto-magnetic ("AM") resonators. For example "AM" tags are devices that exhibit specific response properties when activated and deactivated. When activated, AM tags resonate and transmit a signal at a resonant frequency when stimulated by an interrogation signal at a particular frequency. The receiver subsequently detects this characteristic response. The properties of "deactivated" AM tags result in the inability to transmit a signal at the resonant frequency. By design, the characteristic response of the tag is distinctive and not likely to be created by natural circumstances.

A consideration in connection with the design and use of such EAS systems is to minimize the occurrence of false alarms which could either cause embarrassment to customers of an EAS system user, e.g., a retail store, or produce annoying and disruptive alarm signals when no one is passing through the store's EAS system. There are various types of false alarm signals including a "false" alarm that occurs when a shopper passes through the EAS system without possessing any tag-bearing or protected merchandise, but an alarm is nevertheless sounded. Yet another more specific type of false alarm signal is the "merchandise" alarm, which occurs when a shopper carries non-protected merchandise through the EAS system which nevertheless exhibits the characteristics of an active tag. Examples of this are items such as extension cords and cables, foldable chairs, and other coiled metal objects that are capable of resonance in the presence of the electromagnetic field of an EAS system. Another specific type of false alarm signal is the "phantom" alarm, which occurs when an EAS system sounds an alarm responsive to the detection of an "ambient" signal, generally when there is no one passing through the EAS system. Examples are false alarm signals produced by tag-bearing merchandise placed on display near enough to the EAS system to accidentally cause an alarm condition or when tag-bearing merchandise is temporarily introduced into the detection zone but does not exit the retail space.

Another type of false alarm occurs with there is a failure to deactivate ("FTD") event which occurs when a tag is improperly deactivated or "wounded". A tag is "wounded" when the tag has not been completely deactivated but remains in a state where the tag is on the threshold of being a valid tag. For example, in current EAS systems, when AM tags (also referred to herein as "labels") are properly deactivated one can expect the frequency of the label as detected by the system receiver to be approximately 59.3 kHz. The AM detector's frequency criterion rejects detection of labels with frequencies greater than 58.6 kHz. In some cases a partially or inappropriately deactivated labels may have a frequency less than 58.6 kHz, in which case the system will unintentionally alarm (false alarm).

What is needed is a method and system that can be used to reduce or eliminate false alarms in EAS system detection zones especially when tags have not been properly deactivated.

SUMMARY OF THE INVENTION

The present invention advantageously provides a method, system and computer program product for managing false alarms in a security system. In one embodiment, the present invention provides method for managing false alarms in a security system in which a detection zone is established. An alarm event is triggered based on the detection of a tag in the detection zone using an initial alarm trigger sensitivity. The initial alarm trigger sensitivity is based on an initial set of one or more detection criteria. The set of detection criteria is modified to adjust the alarm trigger sensitivity of the security system.

In accordance with another aspect, the present invention provides a system for managing false alarms. A transmitter produces an applied interrogation field in a detection zone. A processor operates to trigger an alarm event in response to the detection of a tag in the detection zone using an initial alarm trigger sensitivity in which the initial alarm trigger sensitivity is based on an initial set of one or more detection criteria, and modify the set of detection criteria to adjust the alarm trigger sensitivity of the security system.

In accordance with another aspect, the present invention provides a computer program product including a computer usable medium having a computer readable program for a security system which when executed on a computer causes the computer to perform a method that includes the establishment of a detection zone. An alarm event is triggered based on the detection of a tag in the detection zone using an initial alarm trigger sensitivity. The initial alarm trigger sensitivity is based on an initial set of one or more detection criteria. The set of detection criteria is modified to adjust the alarm trigger sensitivity of the security system.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
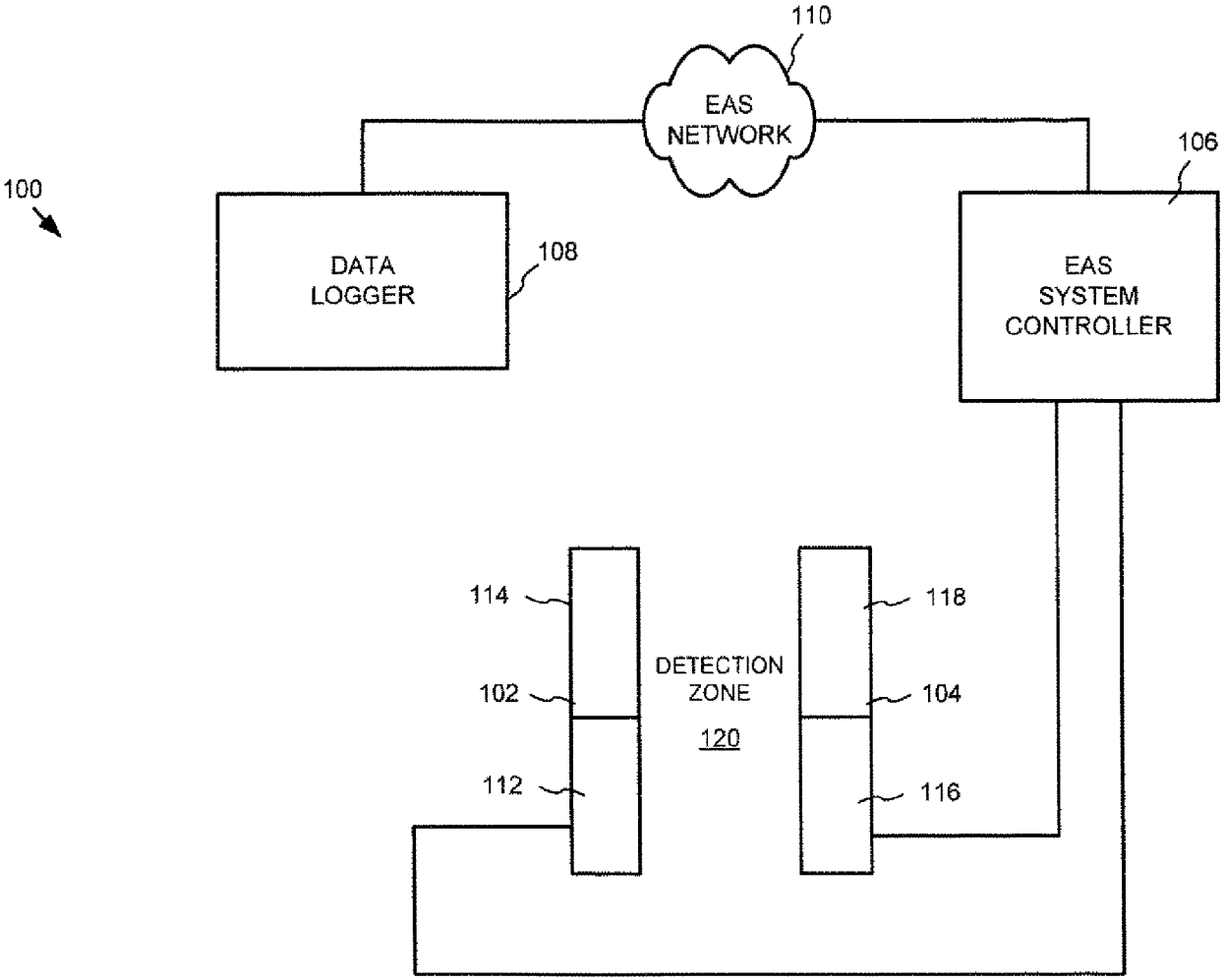
FIG. 1 is a block diagram of an electronic article surveillance system constructed in accordance with the principles of the present invention.

Referring now to the drawing figures in which like reference designators refer to like elements, there is shown in FIG. 1 a diagram of an exemplary system constructed in accordance with the principles of the present invention and designated generally as "100". Electronic article surveillance ("EAS") system 100 includes EAS detection units 102, 104 positioned generally in parallel and at a spaced distance from one another, EAS system controller 106 in communication with EAS detection units 102, 104, and data logger 108 in communication with EAS controller 106 via an EAS network 110. EAS detection unit 102 can include a transmitter 112 and a transmitting antenna 114 for producing the electromagnetic fields that are used in conjunction with such systems to detect the presence of a tag (not shown) affixed to merchandise to be protected. The remaining EAS detection unit 104 includes a receiver 116 and a receiving antenna 118, which then operate to detect a disturbance (resulting from the presence of an active tag) in the electromagnetic fields produced by the EAS detection unit 102, which can be used to sound an appropriate alarm. EAS system 100 can create a detection zone 120 in space, e.g., retail spaces of a store, a store exit, etc.

In another embodiment, a single EAS detection unit 102 is provided that uses a transceiver 112 and a transceiver antenna 114 to establish detection zone 120 by generating the electromagnetic fields that are used to detect the presence of tags affixed to merchandise to be protected. In this embodiment, transceiver 112 and transceiver antenna 114 also function to receive a disturbance in the produced electromagnetic field of EAS detection unit 102. For example, although FIG. 1 shows EAS detection unit 102 deployed in a pedestal, the transceiver 112 and/or the transceiver antenna 114 or both can be deployed, for example, on a door or at a store exit. In this embodiment, transceiver antenna 114 radiates the appropriate electromagnetic or radio frequency field to produce the detection zone 120.

The processing of data and signals developed by the EAS detection units 102, 104 of the EAS system 100 is accomplished by an EAS system controller 106 associated with the EAS system 100 that can be a standalone unit or an integrated unit, e.g., positioned within the transceivers/receivers 112, 116. In certain embodiments, the controller 106 executes one or more processes associated with EAS applications. In this embodiment, the controller 106 is used to analyze detection signals received by the receiver 116 to determine the presence of a tag in detection zone 120 between the EAS detection units 102 and 104. The controller 106 executes instructions and manipulates data to perform the operations of EAS system 100 and may be, for example, a central processing unit ("CPU"), an application specific integrated circuit ("ASIC") or a field-programmable gate array ("FPGA"). The controller 106 also controls the activation or enablement of the transmitters, e.g., transmitter 112, for all the various configurations of EAS system 100.

Figure 2:
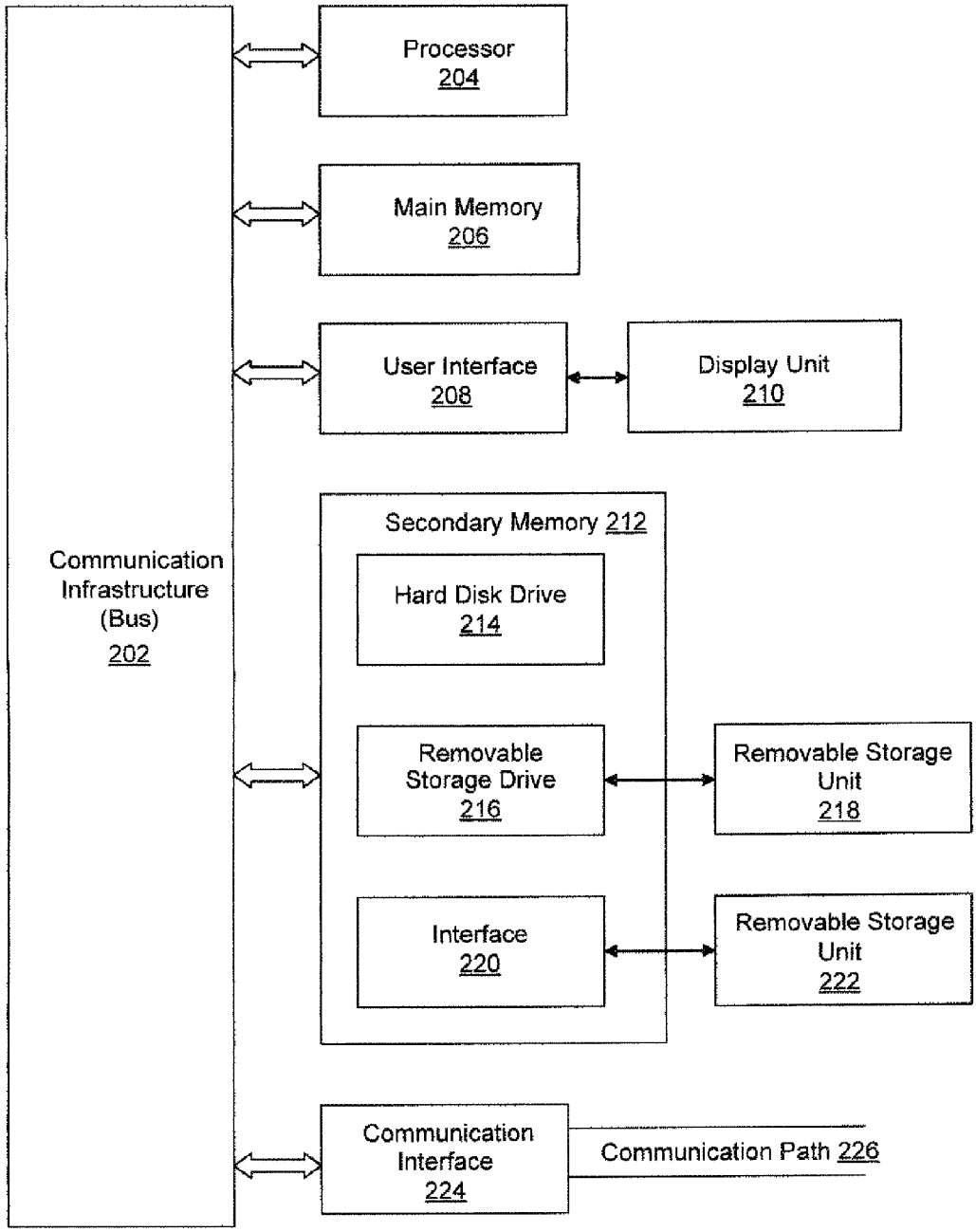
FIG. 2 is a block diagram of an exemplary data logger of the electronic article surveillance system of FIG. 1, that is constructed in accordance with the principles of the present invention.

EAS system 100 includes a data logger 108, which is a unit that tracks the quantity and type of alarm events that occur in detection zone 120. The data logger 108 of FIG. 2 includes one or more processors, such as processor 204. The processor 204 is connected to a communication infrastructure 202, e.g., a communications bus, cross-over bar, or wired/wireless network. Various software embodiments are described in terms of this exemplary data logger 108. After reading this description, it will become apparent to a person of ordinary skill in the relevant art(s) how to implement the invention using other computer systems and/or computer-based architectures.

The data logger 108 can include a user interface 208 that forwards graphics, text, and other data from the communication infrastructure 202 (or from a frame buffer not shown) for presentation on the display unit 210. The user interface 208 serves as an input device for human interaction. In certain embodiments, controller 106 may receive commands from the operator through the user interface 208, as well as other input devices, such as a mouse or keyboard. For example, the data logger 108 can have a series of buttons on the periphery of the user interface 208 that allow an operator to enter a reason code for an alarm event.

The data logger 108 also includes a main memory 206, preferably random access memory (RAM), and may also include a secondary memory 212. The secondary memory 212 may include, for example, a hard disk drive 214 and/or a removable storage drive 216, representing a floppy disk drive, a magnetic tape drive, an optical disk drive, flash drive/memory, etc. The removable storage drive 216 reads from and/or writes to a removable storage unit 218 in a manner well known to those having ordinary skill in the art. Removable storage unit 218, represents, for example, flash memory, a floppy disk, magnetic tape, optical disk, etc. which is read by and written to by removable storage drive 216. As will be appreciated, the removable storage unit 218 includes a computer usable storage medium having stored therein computer software and/or data.

In alternative embodiments, the secondary memory 212 may include other similar means for allowing computer programs or other instructions to be loaded into the data logger 108. Such means may include, for example, a removable storage unit 222 and an interface 220. Examples of such may include a program cartridge and cartridge interface (such as that found in video game devices), a removable memory chip (such as a, flash, EPROM, or PROM) and associated socket, and other removable storage units 222 and interfaces 220 which allow software and data to be transferred from the removable storage unit 222 to the data logger 108.

The data logger 108 may also include a communications interface 224. The communications interface 224 allows software and data to be transferred between the data logger 108 and external devices, e.g., EAS system controller 106. Examples of communications interface 224 may include a modem, a network interface (such as an Ethernet card), a communications port, a PCMCIA slot and card, etc. Software and data transferred via communications interface 224 are in the form of signals which may be, for example, electronic, electromagnetic, optical, or other signals capable of being received by communications interface 224. These signals are provided to communications interface 224 via a communications path or channel 226. Channel 226 carries signals and may be implemented using wire or cable, fiber optics, a phone line, a cellular phone link, an RF link, and/or other communications channels. In one embodiment, the data logger 108 communicates with EAS system controller 106 via a network, e.g., EAS network 110 that can include but is not limited to various interface or data link standards such as recommended standard 232 ("RS-232"), recommended standard 485 ("RS-485"), universal serial bus ("USB"), Ethernet transmission control protocol/internet protocol ("TCP/IP"), etc.

The terms "computer program medium," "computer usable medium," and "computer readable medium" are used to generally refer to media such as main memory 206 and secondary memory 212, removable storage drive 216, a hard disk installed in hard disk drive 214, and signals. These computer program products are means for providing software to the data logger 108. The computer readable medium allows the data logger 108 to read data, instructions, messages or message packets, and other computer readable information from the computer readable medium. The computer readable medium, for example, may include non-volatile memory, such as floppy, ROM, flash memory, disk drive memory, CD-ROM, and other permanent storage. It is useful, for example, for transporting information, such as data and computer instructions, between computer systems. Furthermore, the computer readable medium may comprise computer readable information in a transitory state medium such as a network link and/or a network interface, including a wired network or a wireless network that allows data logger 108 to read such computer readable information.

Computer programs (also called computer control logic) are stored in main memory 206 and/or secondary memory 212. Computer programs may also be received via communications interface 224. Such computer programs, when executed, enable the data logger 108 to perform the features of the present invention as discussed herein. In particular, the computer programs, when executed, enable the processor 204 to perform the features of the data logger 108.

Figure 3:
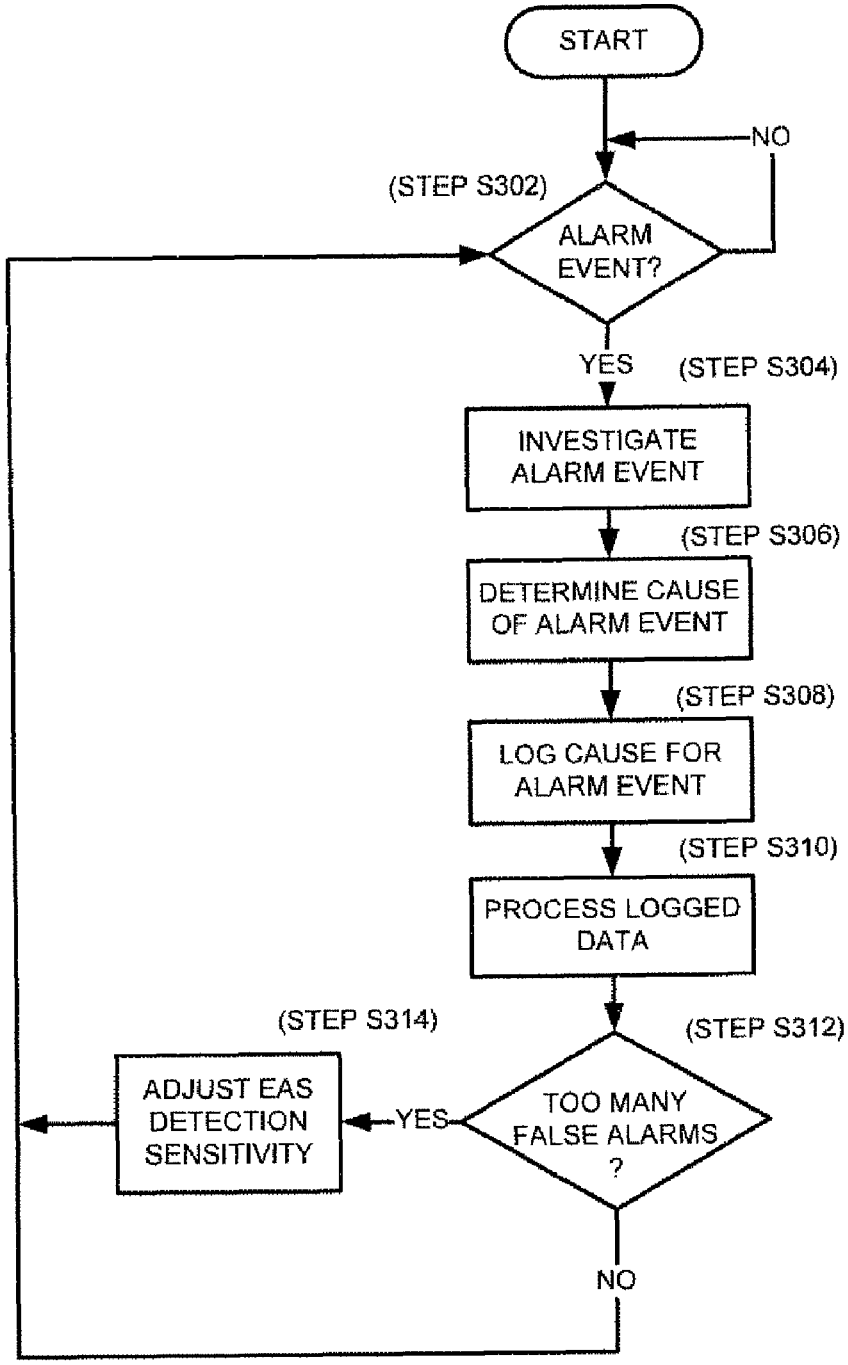
FIG. 3 is a flowchart of an exemplary false alarm reduction process in accordance with the principles of the present invention.

FIG. 3 is a flow chart illustrating an exemplary method for false alarm management of EAS system 100 using a data logger 108. The exemplary method is discussed with reference to EAS system 100, however, any other suitable system or portion of a system may use appropriate embodiments of the method to retrieve and process logged EAS information to manage the sensitivity of EAS detection units 102, 104 in EAS detection zone 120. Generally, the method for false alarm management describes a tag entering a detection zone 120 to generate an alarm event.

At step S302, a determination is made as to whether an alarm event has occurred, such as when a tag affixed to an object, e.g., a piece of merchandise, enters the detection zone 120. If no alarm event is detected, then step S302 is repeated until an alarm event occurs. Once an alarm event occurs, the alarm event is investigated (step S304) by, for example, the employees of the company deploying the security system 100.

At step S306, the cause of the alarm event is determined and that cause of the alarm event is logged at step S308. In one embodiment, investigators, e.g., employees of the company deploying the security system 100, determine the cause of the alarm event, which can be, for example, a failure to deactivate ("FTD"), a false alarm, e.g., a merchandise false alarm or a valid alarm, e.g., an alarm caused by unauthorized removal of an object for the company's premises. Each of the alarm event types can have an assigned "reason code", which allows the investigator to input to or select from the data logger 108 to thereby log the proper cause of the alarm event. Once the information for the alarm event is logged into (or received by) the data logger 108, this information is sent back to the EAS system controller 106 in real or delayed time for analysis and storage. For example, an alarm event is investigated and determined to be the result of a false alarm and a reason code for a false alarm is input into the data logger 108, e.g., by an investigator. At step S310, the reason code and information related to the alarm event is transmitted to the EAS system controller 106 for processing and analysis.

If it is determined that there have been too many false alarms (step S312) then the system can be adjusted to change its alarm trigger sensitivity to a level that is less sensitive allowing for less false alarms. If there are not too many false alarms or failures to deactivate, the process returns to step S302 to wait for the next alarm event.

In accordance with one embodiment, the adjustment can be made manually using data logger 108 discussed above. In another embodiment discussed below in detail, alarm trigger sensitivity can be reduced by reducing the allowable frequencies for an alarm event. In other words, the frequency threshold is automatically adjusted to prevent alarm events at the frequency of the logged false alarms. In yet another embodiment also discussed below the EAS system can automatically raise the signal to noise ratio ("SNR") threshold in an attempt to reduce the likelihood of another false event. In accordance with both of these embodiments, system adjustment is automatic and need not employ the use of data logger 108. As such, EAS system controller 106 is arranged to operate without manual intervention and manual adjustment.

Figure 4:
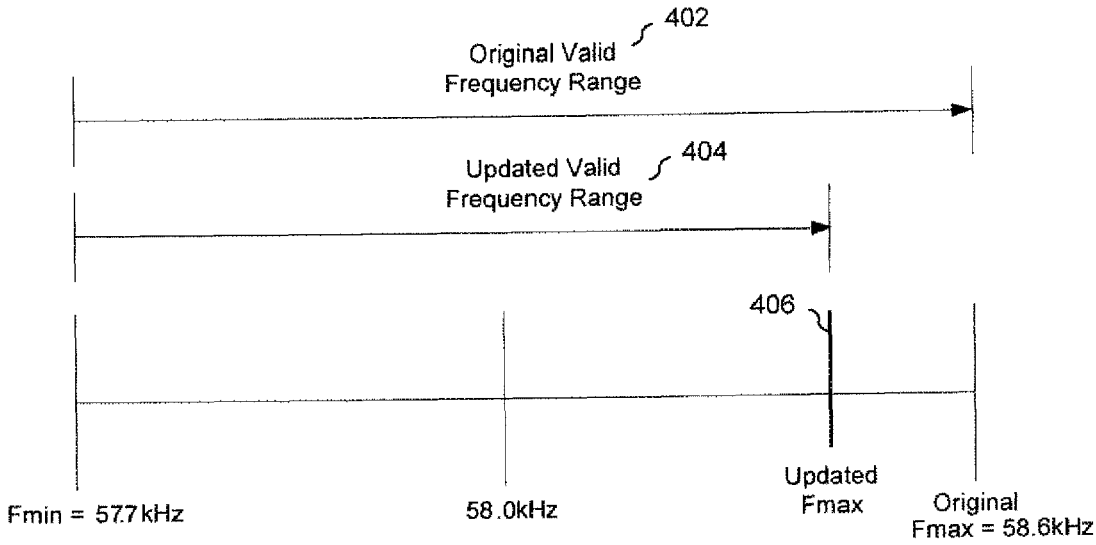
FIG. 4 is a diagram showing alarm activation frequency range adjustment in accordance with the principles of the present invention.
Figure 5:
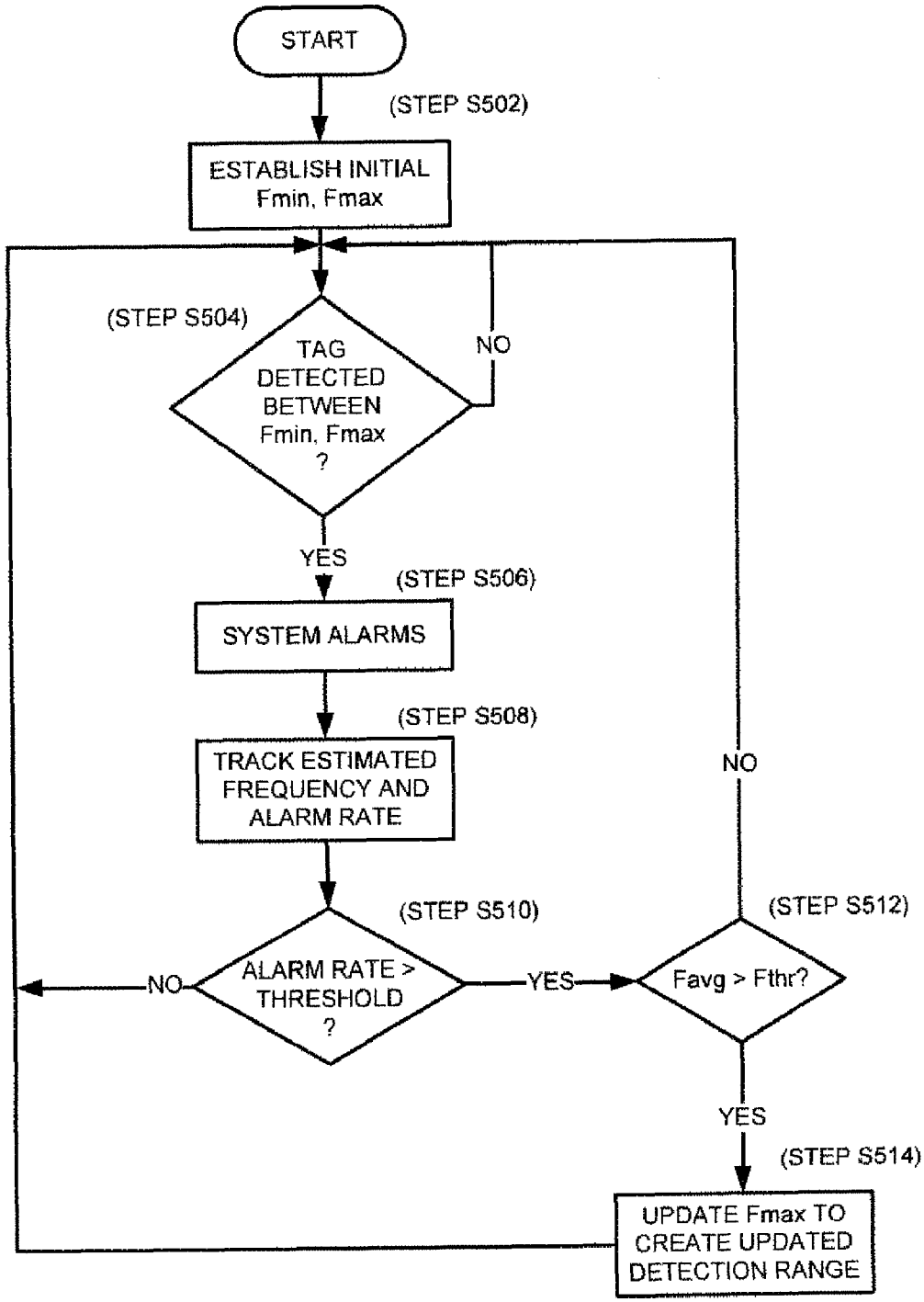
FIG. 5 is a flowchart of an alarm activation frequency range adjustment process in accordance with the principles of the present invention.

An example of tracking the estimated label frequency for each alarm while keeping track of the alarm rate is explained with reference to the frequency diagram of FIG. 4 and the automatic adjustment process shown in FIG. 5. Current AM detectors use frequency estimation algorithms to estimate the actual frequency of AM tags when detected by the system. The present invention compares this frequency estimation to a predetermined initial range of valid frequencies (Fmin, Fmax) 402. For example an initial Fmin and Fmax are established (Step S502). As shown in FIG. 4, Fmin in FIG. 4 is 57.7 kHz and the initial Fmax is shown as 58.6 kHz. This assumes that a preferred received frequency for an activated tag is 58.0 kHz. If the estimated tag frequency falls within the valid range (step S504), then the tag is considered valid and the system alarms (step S506). Otherwise the tag is considered deactivated or out of the frequency range. Methods for estimating the frequency of a received signal, such as the signal corresponding to an AM tag, are known and are outside the scope of the present invention.

As noted above, the present invention, such as via controller 106, tracks the estimated tag frequency for each alarm while keeping track of the alarm rate (step S508). Controller 106 also tracks the estimated average frequency (Favg) of the tags that caused an alarm. If a considerable increase in the alarm rate above a predetermined alarm rate threshold is detected (step S510), controller 106 compares the estimated average frequency (Favg) of tags causing alarms to a FTD Frequency Threshold (Fthr) (step S512). If the estimated average is higher than the FTD Threshold the system will automatically decrease the maximum frequency (Fmax) of the valid frequency to create a new updated range 404 (step S514) by setting the updated maximum value (updated Fmax) 406 to be smaller than the FTD Threshold.

For example, natural frequency, also referred to as characteristic frequency, of a live tag is approximately 58 kHz. Consequently, detection platforms are designed to have an operating frequency ranging from approximately, 57.7 kHz to 58.3 kHz. When a tag is properly deactivated, the deactivated tag's characteristic frequency is typically shifted to the 59-60 kHz range, which is effectively out of the detection range and thus can no longer trigger an alarm event. However, a partially deactivated, or "wounded" tag may have its characteristic frequency shifted to the 58.7-59 kHz range and thus can potentially be detected if the energy is sufficiently large at the tag's new spectral attributes, e.g., the tag's characteristic frequency. Accordingly, by decreasing the frequency range of what is considered a valid activated tag, wounded tags that would otherwise falsely alarm the system are no longer considered, even if improperly, valid tags. It is noted that this arrangement is most accurate in high signal-to-noise ratio ("SNR") environments, since the accuracy of frequency estimation algorithms decreases with a decrease in SNR.

Figure 6:
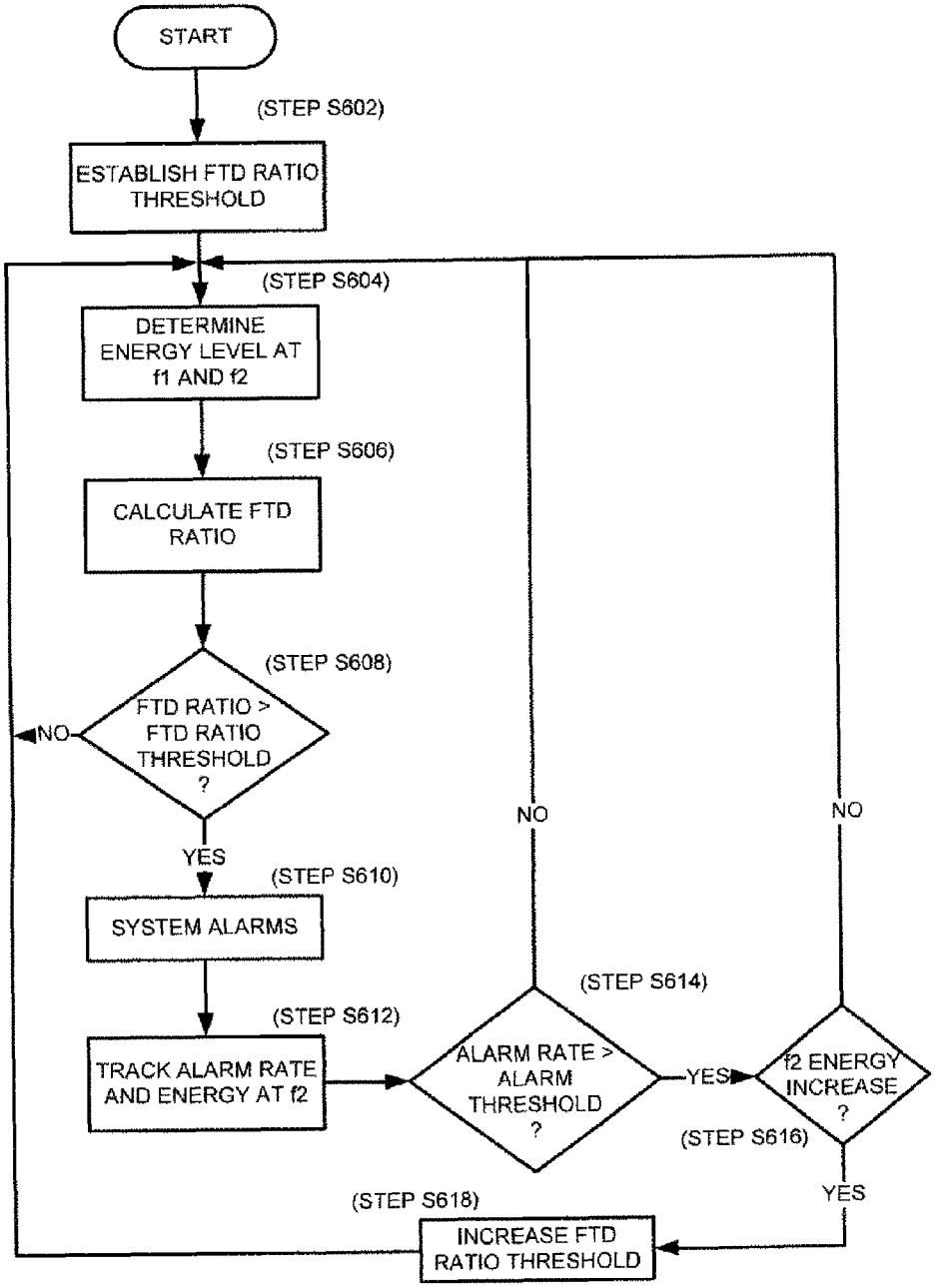
FIG. 6 is a flowchart of an energy-based alarm activation process in accordance with the principles of the present invention.

As noted above, the present invention also provides an arrangement by which the failure to deactivate method is based on adjusting the detection criteria. In accordance with this embodiment, the detection criteria is based on a comparison of the energy levels at certain tag detection frequencies. The effect is that this embodiment is less sensitive to changes in SNR and even to poor SNR environments because the system is adjusted in a manner that does not consider noise because the same level of noise is generally present in the energy level of monitored frequencies. A description of energy-based alarm activation is described with reference to FIG. 6.

In accordance with this embodiment, a FTD ratio is established (step S602). This ratio, described below in detail, is used as a basis for determining whether the energy level at a first frequency is sufficiently large enough to trigger an alarm.

In operation, EAS system controller 106 calculates (step S604) and compares the received tag energy at two different frequencies. For example, the first frequency (f1) is the valid received frequency of a tag, e.g., 58 kHz, and the second frequency (f2) is the expected deactivated frequency of a label, e.g., 59.3 kHz. However, in low SNR environments, even though there may be enough 58 kHz energy to trigger an alarm, if more label energy is seen at 59.3 kHz as compared to 58 kHz then the system considers the label to be deactivated and will not alarm.

In accordance with this embodiment a FTD ratio is calculated (step S606) to compare the received tag energy levels at the two frequencies. For example, FTD ratio=f1 energy/f2 energy. Using the exemplary values provided above, FTD ratio=58 kHz energy/59.3 kHz energy.

The ratio is then compared to a predetermined FTD ratio threshold. The FTD ratio threshold is the minimum amount of energy that must be present at f1 above the energy level at f2 to trigger an alarm. If the FTD ratio is higher than the FTD ratio threshold (step S608), it is determined that the label energy at f1 (58 kHz) is higher than at f2 (59.3 kHz) and controller 106 activates an alarm (step 610).

For example, to reduce FTD alarms due to tag frequencies close to 58.6 kHz, controller 106 can initially track the average energy at f2 (59.3 kHz) for tags that triggered an alarm, while also tracking the alarm rate (step S612). If a considerable increase in the alarm rate is detected above a threshold alarm rate (step S614), controller 106 evaluates the energy level at the f2 (59.3 kHz) average and determine if the energy level at f2 (59.3 kHz) increased during the alarms (step S616). If the energy level increased, the FTD threshold is incremented by a predetermined amount to reduce false alarms (step S618). The result is that the sensitivity of the system is decreased to reduce the instances of false alarms.

The adjustment of the EAS system detection sensitivity by comparing and then adjusting energy level thresholds and/or by reducing the allowable frequencies for an alarm event are included as detection criteria in accordance with the present invention. The use of such detection criteria advantageously applies to both the failure to deactivate problem and the false alarm issues. Of note, although the functions for automatic adjustment of the alarm trigger threshold frequency and energy level ratios are described with reference to EAS system controller 106, it is understood that these functions need not be performed solely by controller 106. It is understood that a separate computing device can be in electronic communication with controller 106 and that this separate computing device can be programmed to perform the functions for automatic adjustment of the alarm triggers described herein.

The present invention advantageously provides and defines a comprehensive system and method for reducing false alarms and failures to deactivate in an EAS system using real-time data logging technologies.

The present invention can be realized in hardware, software, or a combination of hardware and software. An implementation of the method and system of the present invention can be realized in a centralized fashion in one computing system or in a distributed fashion where different elements are spread across several interconnected computing systems. Any kind of computing system, or other apparatus adapted for carrying out the methods described herein, is suited to perform the functions described herein.

A typical combination of hardware and software could be a specialized or general-purpose computer system having one or more processing elements and a computer program stored on a storage medium that, when loaded and executed, controls the computer system such that it carries out the methods described herein. The present invention can also be embedded in a computer program product, which comprises all the features enabling the implementation of the methods described herein, and which, when loaded in a computing system is able to carry out these methods. Storage medium refers to any volatile or non-volatile storage device.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form. In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

It will be appreciated by persons skilled in the art that the present invention is not limited to what has been particularly shown and described herein above. A variety of modifications and variations are possible in light of the above teachings without departing from the spirit or essential attributes thereof, and accordingly, reference should be had to the following claims, rather than to the foregoing specification, as indicating the scope of the of the invention.

What is claimed is:

1. A method for managing false alarms in a security system, the method comprising:

establishing a detection zone;

triggering an alarm event, the alarm event based on the detection of a tag in the detection zone using an initial alarm trigger sensitivity, the initial alarm trigger sensitivity being based on an initial set of one or more detection criteria; and modifying the set of detection criteria, including adjusting an energy level ratio threshold at preselected tag detection frequencies, to adjust the alarm trigger sensitivity of the security system.

2. The method of claim 1, further comprising determining a reason for the alarm event.

3. The method of claim 1, further comprising receiving a reason code, the reason code including information relating to the alarm event.

4. The method of claim 3, wherein the modifying the set of detection criteria includes:

processing reason code information to determine one or more of the detection criteria to modify; and storing the modified one or more detection criteria.

5. The method of claim 1, wherein the alarm event is triggered if a ratio of detected first energy level at a first frequency to a detected second energy level at a second frequency is greater than a predetermined energy level ratio threshold.

6. The method of claim 1, wherein the alarm trigger sensitivity is adjusted to increase the alarm trigger sensitivity of the security system, increasing the alarm trigger sensitivity of the security system includes increasing the predetermined energy level ratio threshold.

7. The method of claim 1, wherein the set of detection criteria includes a frequency threshold.

8. The method of claim 7, wherein a range of valid alarm trigger frequencies is reduced when an average detected frequency for tags causing an alarm is greater than the frequency threshold.

9. A system for managing false alarms in a security system, the system comprising:

a transmitter producing an applied interrogation field in a detection zone;

a processor, the processor operating to:

trigger an alarm event in response to the detection of a tag in the detection zone using an initial alarm trigger sensitivity, the initial alarm trigger sensitivity being based on an initial set of one or more detection criteria; and modify the set of detection criteria, including adjusting an energy level ratio threshold at preselected tag detection frequencies, to adjust the alarm trigger sensitivity of the security system.

10. The system of claim 9, wherein the processor further operates to determine the cause of the alarm event.

11. The system of claim 9, wherein the processor further operates to:

process reason code information to determine one or more of the detection criteria to modify; and store the modified one or more detection criteria.

12. The system of claim 11, wherein the processor operates to trigger the alarm event if a ratio of detected first energy level at a first frequency to a detected second energy level at a second frequency is greater than a predetermined ratio threshold.

13. The system of claim 11, wherein the processor further operates to adjust the alarm trigger sensitivity by increasing the alarm trigger sensitivity of the security system, increasing the alarm trigger sensitivity of the security system includes increasing the predetermined energy level ratio threshold.

14. The system of claim 9, wherein the set of detection criteria includes a frequency threshold.

15. The system of claim 14, wherein the processor further operates to reduce a frequency range for detecting an active tag when an average detected frequency for tags causing an alarm to trigger is greater than the frequency threshold.

16. A processor having computer program instructions for operating a security system, the processor causing a computer to perform a method comprising:

establishing a detection zone;

triggering an alarm event, the alarm event based on the detection of a tag in the detection zone using an initial alarm trigger sensitivity, the initial alarm trigger sensitivity being based on an initial set of one or more detection criteria; and modifying the set of detection criteria, including adjusting an energy level ratio threshold at preselected tag detection frequencies, to adjust the alarm trigger sensitivity of the security system.

17. The method according to claim 16, wherein the alarm event is triggered if a ratio of detected first energy level at a first frequency to a detected second energy level at a second frequency is greater than a predetermined energy level ratio threshold, wherein the alarm trigger sensitivity is adjusted to increase the alarm trigger sensitivity of the security system, increasing the alarm trigger sensitivity of the security system includes increasing the predetermined energy level ratio threshold.

18. The method according to claim 16, wherein modifying the set of detection criteria further includes reducing frequency range for detecting an active tag when an average detected frequency for tags causing an alarm to trigger is greater than the frequency threshold.

19. A system for managing false alarms in a security system, the system comprising:

a transmitter producing an applied interrogation field in a detection zone;

a processor, the processor operating to:

trigger an alarm event in response to the detection of a tag in the detection zone using an initial alarm trigger sensitivity, the initial alarm trigger sensitivity being based on an initial set of one or more detection criteria; and modify the set of detection criteria, including reducing a frequency range for detecting an active tag, to adjust the alarm trigger sensitivity of the security system.

20. The system of claim 19, wherein the processor further operates to reduce the frequency range for detecting an active tag when an average detected frequency for tags causing an alarm to trigger is greater than the frequency threshold.

* * * * *